US008403020B2

(12) United States Patent
Rasmussen

(10) Patent No.: US 8,403,020 B2
(45) Date of Patent: Mar. 26, 2013

(54) DEVICE FOR FINE ADJUSTMENT OF ROLLER BLINDS

(75) Inventor: Ken Rasmussen, Ringe (DK)

(73) Assignee: Faber A/S, Ryslinge (DK)

( * ) Notice: Subject to any disclaimer, the term of this patent is extended or adjusted under 35 U.S.C. 154(b) by 0 days.

(21) Appl. No.: 13/032,003

(22) Filed: Feb. 22, 2011

(65) Prior Publication Data

US 2012/0043032 A1 Feb. 23, 2012

Related U.S. Application Data

(63) Continuation of application No. 11/910,804, filed as application No. PCT/DK2006/000174 on Mar. 28, 2006, now Pat. No. 7,891,399.

(30) Foreign Application Priority Data

Mar. 29, 2005 (DK) ..... 2005 00465

(51) Int. Cl.
*E06B 9/174* (2006.01)

(52) U.S. Cl. ..... 160/120; 160/323.1

(58) Field of Classification Search ..... 160/120, 160/307, 308, 323.1; 192/12 BA, 41 S; 248/267, 248/268

See application file for complete search history.

(56) References Cited

U.S. PATENT DOCUMENTS

| | | | | |
|---|---|---|---|---|
| 2,870,831 | A | 1/1959 | Peselnick | |
| 3,298,197 | A | 1/1967 | Roth | |
| 4,372,432 | A | 2/1983 | Waine et al. | |
| 4,424,851 | A * | 1/1984 | Kohayakawa | 160/298 |
| 4,657,059 | A | 4/1987 | Clauss | |
| 4,751,953 | A | 6/1988 | Appel et al. | |
| 4,836,264 | A | 6/1989 | Machin | |
| 4,865,109 | A | 9/1989 | Sherman | |
| 5,031,682 | A | 7/1991 | Tedeschi | |
| 6,978,822 | B2 | 12/2005 | Schoonen | |
| 7,051,782 | B2 | 5/2006 | Nichols et al. | |
| 7,100,668 | B2 | 9/2006 | Allsop | |

FOREIGN PATENT DOCUMENTS

JP 10-072987 A 3/1998

OTHER PUBLICATIONS

International Search Report for PCT/DK2006/000174; Jun. 21, 2006.

* cited by examiner

*Primary Examiner* — David Purol
(74) *Attorney, Agent, or Firm* — Pearne & Gordon LLP

(57) ABSTRACT

A roller blind device includes a drive shaft and two neighboring roller blinds on the drive shaft that are adapted to be adjustable with respect to each other. At least one of the roller blinds may be uncoupled from the drive shaft without the use of tools. Once uncoupled, the roller blinds may be adjusted with respect to each other. The roller blind may then be coupled to the drive shaft, allowing for the two neighboring roller blinds to be lowered and raised.

14 Claims, 3 Drawing Sheets

DEVICE FOR FINE ADJUSTMENT OF ROLLER BLINDS

This application is a continuation of U.S. patent application Ser. No. 11/910,804 filed Oct. 23, 2008, which is incorporated herein by reference in its entirety.

FIELD

The invention relates to a device for fine adjustment of at least one roller blind relative to a driving shaft comprising a roller blind tube with two end plugs and a drive shaft in engagement with at least one end plug.

BACKGROUND

A number of roller blinds for use in very long window openings may be manipulated synchronously by driving the outermost roller blind at one side and to transmit the rotation from one to the next, there being bearing brackets with bearings provided between the roller blinds. Frequently, the end plugs will engage small pieces of drive shaft that are carried in the bearing brackets.

However, differences in the rolling that have occurred during installation may entail that some of the roller blinds fitted hang lower and cannot be raised completely, because the drive motor stops when the first roller blind has reached its upmost position. There is hence a need to turn a neighbouring roller blind in order that it may be fine-adjusted independently of the others. This must occur by uncoupling the force transmitting element between the roller blind tubes.

An uncoupling between two tubes may occur by sideways shifting of a cylindrical bushing that engages both tubes, in order that the tubes may be turned independently. Such a solution cannot be used, however, when there is fitted a bearing bracket between the tubes. The bearing bracket carries a short piece of shaft between the tubes mentioned and is essential to retain the straightness of the axis of rotation, even though it is long. An uncoupling may be obtained in this case in that a bushing with a grub screw connects one of the roller blind tubes with the piece of shaft. Such a bushing may be loosened by loosening the grub screw, the adjustment may be performed, and the grub screw is tightened again. This is a solution that requires tools and furthermore that the grub screw is accessible, i.e. facing the room in which the roller blind is placed. This means that when adjusting, the roller blind must be lowered until the grub screw is accessible. Furthermore, a grub screw for fine adjustment must work against a cylindrical part of a shaft. However, drive shafts for roller blinds frequently have a polygonous cross section in order to transmit a torque.

Hence there must be a part of a drive shaft that needs special machining in order to provide a cylindrical surface, and this is costly. A lowering in this situation would occur by means of the usual control unit, which is frequently fixed in one place, while the adjustment must occur between the two roller blinds that do not have the same rolled length. The two activities may rarely be performed without the need for the operator to move from one place to the other.

There is hence a need for a fine-adjusting element that is capable of uncoupling a roller blind from a shaft during the fine adjustment and without the use of tools.

SUMMARY

An adjustment device that does not require tools or requirements for the placement of a control unit is particular according to the invention, in that one end plug consists of several parts, some of which may under certain circumstances be rotated with respect to each other, comprising a central part that is surrounded by an unwrap spring having means for engagement with a surrounding part during tightening of the unwrap spring and in that a rotatable control element has means for engaging the unwrap spring in order to loosen it, whereby the roller blind becomes un-coupled from the drive shaft. It will be noted that the rotation of the control element both un-couples the roller blind and turns for fine adjustment in the same movement.

An embodiment of the invention that is particularly useful for solving the fine adjustment problem described above regarding two consecutive roller blinds. The drive shaft is in this case fitted between two end plugs, of which one is fixed and belongs to a first roller blind, and the second belongs to a second roller blind and consists of several parts, in which the drive shaft that is carried by a bearing bracket connects the two end plugs.

In connection with adjustment of limit switches it may be advantageous to be able to adjust also the first roller blind, and according to an embodiment of the invention this may occur by letting the drive shaft connect an end plug consisting of several parts and a motor drive for the roller blind. A motor drive, in which a limit switch has disconnected the current will act as a fixed connection to the surroundings, and it is relative to this fixed connection that it may be desirable to adjust the height of the roller blind.

There are possibilities for various configurations of unwrap spring and the means used for loosening and tightening, respectively. It has been found to be particularly advantageous in a fine adjustment device according to the invention that the unwrap spring has outwards protruding elements that cooperate with an inwards projecting part on the control element therebetween for loosening of the unwrap spring. Hereby a particularly compact construction is obtained, in which the control element has a negligible increase in diameter with respect to the roller blind.

BRIEF DESCRIPTION OF THE DRAWINGS

The invention will be described in greater detail in the following with reference to the drawing, in which.

DETAILED DESCRIPTION

Figure 1:
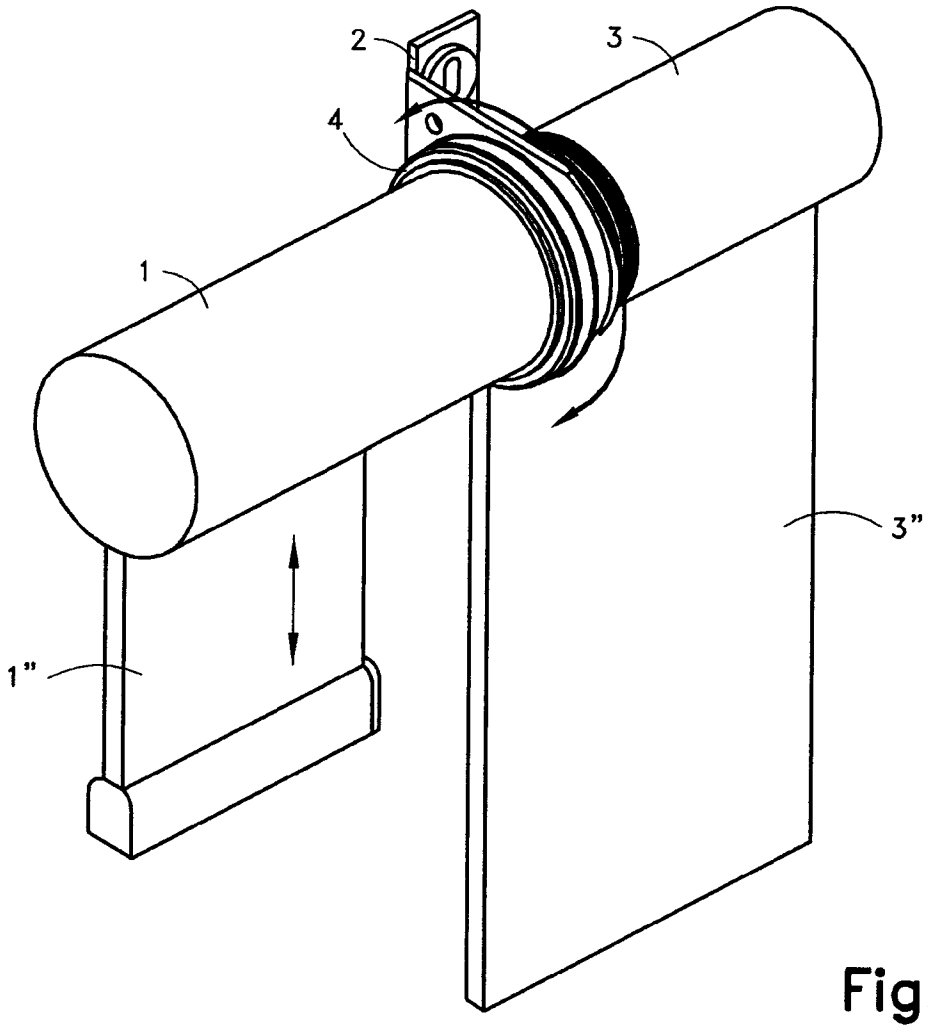
FIG. 1 shows two roller blinds side by side with a difference in height.

In FIG. 1 is seen a first roller blind 1 with a carrier tube (1') inside, a bearing bracket 2, a second roller blind 3 that also has a carrier tube (3') inside. The roller blinds are almost completely raised, but there is a difference in height, because the section 1" is further up than the section 3". Without demonstrating how it is obtained, the functionality is shown that turning the ring 4 may un-couple the roller blind 1, while the end 1" may be raised or lowered. Turning occurs in the direction that entails elimination of the height difference.

Figure 2:
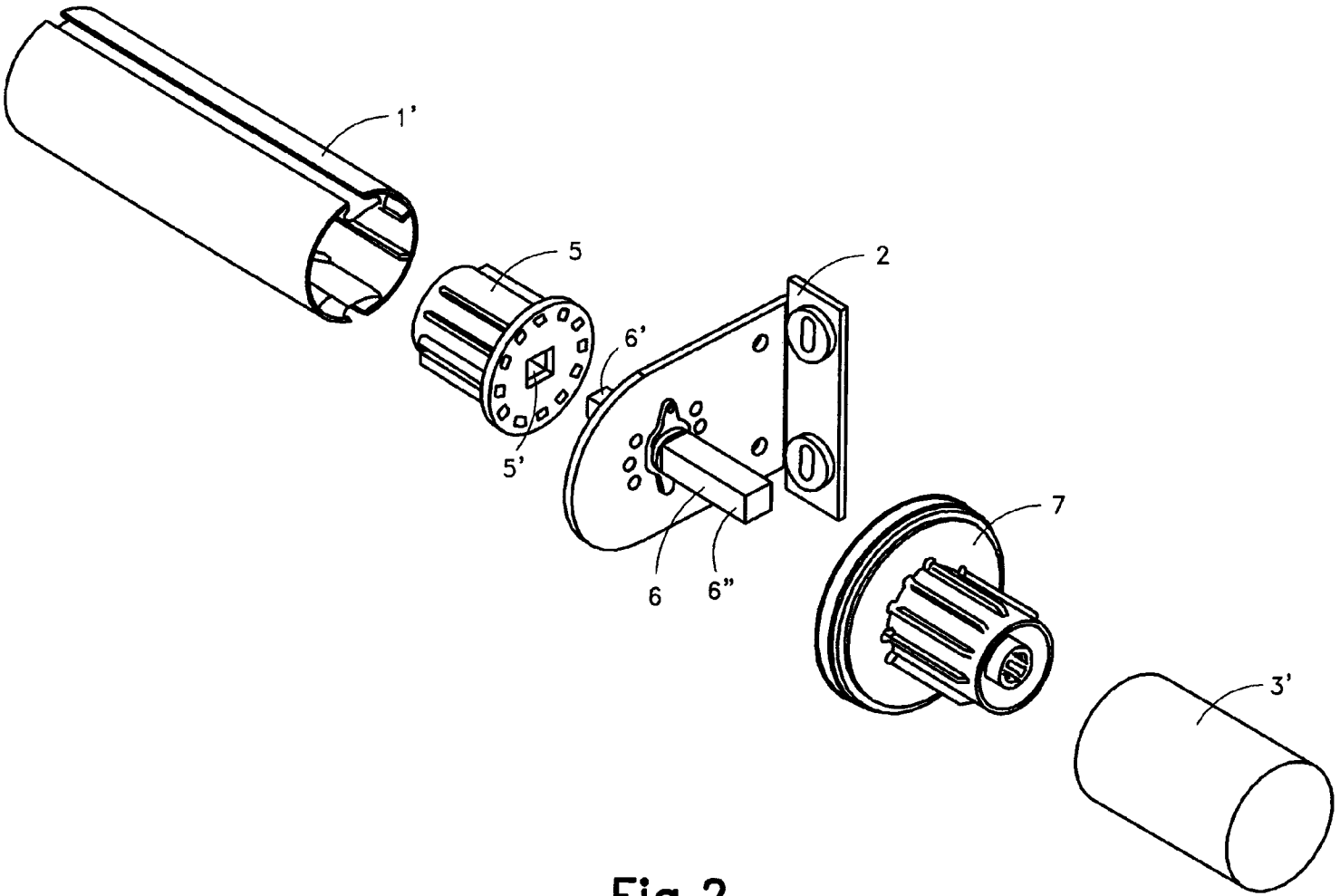
FIG. 2 shows an arrangement for adjustable coupling of two roller blinds.

In FIG. 2 is seen an exploded drawing of a connection in greater detail. It is seen that the carrier tube l' is finished by an end plug 5 that has a rotation transmitting hole 5', in which is fitted one end 6' of a drive shaft 6 that is carried by the bearing bracket 2. The other end 6" is also profiled to transmit rotation, and it engages a second end plug 7 that finishes a carrier tube 3', of the neighboring roller blind. This end plug consists of several parts, as shown in greater detail in FIG. 3.

Figure 3:
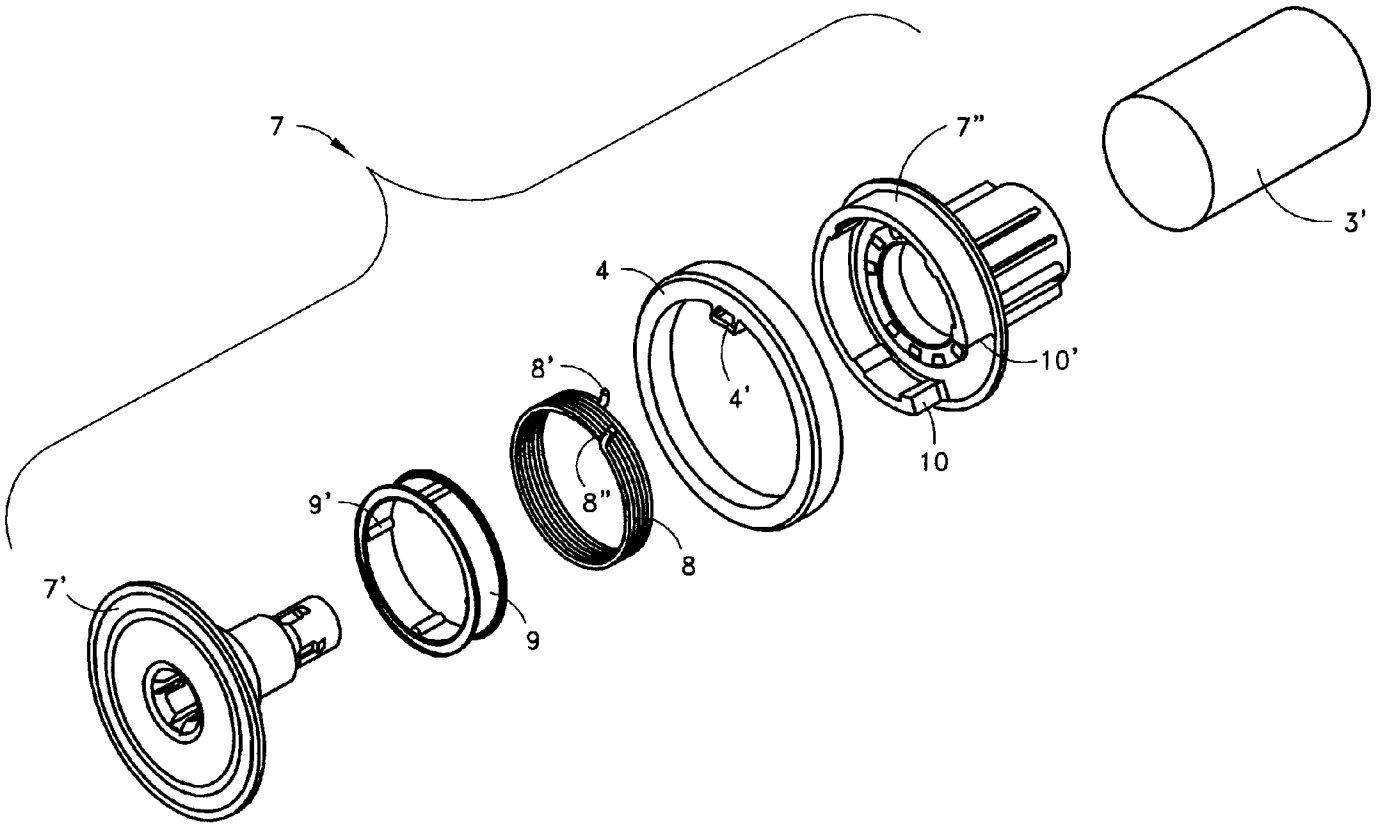
FIG. 3 shows an end plug in several parts with the components it consists of for obtaining adjustability.

In FIG. 3 it is shown that the end plug 7 is a hollow construction consisting of the inner part 7' that cooperates with the end 6" of the drive shaft and a surrounding part 7" that cooperates with the roller blind tube 3'. The two parts 7' and 7" may rotate with respect to each other but are prevented from it by an unwrap spring 8. This is placed on an intermediate tube 9 that is secured against rotation on its placement on the inner part 7' by means of axial protrusions or keys 9'. The unwrap spring 8 grips the intermediate tube 9 firmly, and its outwards directed parts 8' and 8" are placed between the abutments 10 and 10' on the surrounding part, which means that the surrounding part 7" cannot rotate more with respect to the inner part 7' than the space between 8', 8" and the abutments 10, 10'. However, the ring 4 which surrounds the surrounding part 7" and hence the unwrap spring 8, an inwards directed projection 4' that is placed between the two outwards directed parts 8', 8", and by turning in one or the other direction the unwrap spring is loosened, and the surrounding part 7" that is firmly joined to the first roller blind may rotated with respect to the inner part 7' that via the drive shaft is connected to the second roller blind. The action on the unwrap spring is against its direction of winding, and hence it is loosened.

Several configurations of unwrap spring and surfaces for acting on its outwards or inwards facing ends may be manufactured, and the one above described is only one embodiment that has been shown to work well in practice.

The invention claimed is:

1. A roller blind device comprising:

a) a drive shaft;

b) at least one roller blind including a roller blind tube extending along an elongated axis; and c) an end plug including an inner part configured to cooperate with the drive shaft, a surrounding part configured to cooperate with the roller blind tube, an unwrap spring surrounding the inner part with the unwrap spring being configured to be tightened by wrapping the spring with respect to the inner part in order to rotatably couple the roller blind and the drive shaft together, and a rotatable control element configured to engage the unwrap spring to loosen the spring by unwrapping the spring with respect to the inner part in order to rotatably decouple the roller blind from the drive shaft, wherein the drive shaft drives the unwrap spring to rotate, such that the unwrap spring is tightened and engages the surrounding part when driven and rotating in a first direction by the drive shaft and also when driven and rotating in a second direction by the drive shaft.

2. The roller blind device of claim 1, wherein the drive shaft connects the end plug and a motor drive for the roller blind.

3. The roller blind device of claim 1, wherein the unwrap spring includes elements protruding outwardly from an interior of the unwrap spring, and the rotatable control element includes a part projecting inwardly toward the interior of the unwrap spring, wherein the part of the control element is configured to cooperate with the elements of the unwrap spring to loosen the spring.

4. A roller blind device comprising:

a) a drive shaft;

b) at least one roller blind including a roller blind tube extending along an elongated axis; and c) an end plug including an inner part configured to cooperate with the drive shaft, a surrounding part configured to cooperate with the roller blind tube, a helical torsion spring wrapped around the inner part with the helical torsion spring configured to helically tighten with respect to the inner part in order to rotatably couple the roller blind and the drive shaft, and a rotatable control element configured to helically loosen the helical torsion spring with respect to the inner part in order to rotatably decouple the roller blind from the drive shaft, wherein the drive shaft drives the helical torsion spring to rotate, such that the helical torsion spring is tightened and engages the surrounding part when driven and rotating in a first direction by the drive shaft and also when driven and rotating in a second direction by the drive shaft.

5. The roller blind device of claim 4, wherein the drive shaft connects the end plug and a motor drive for the roller blind.

6. The roller blind device of claim 4, wherein the helical torsion spring includes elements protruding outwardly from an interior of the helical torsion spring, and the rotatable control element includes a part projecting inwardly toward the interior of the helical torsion spring, wherein the part of the control element is configured to cooperate with the elements of the helical torsion spring to helically loosen the spring.

7. The roller blind device of claim 1, wherein the roller blind is a first roller blind, the roller blind device further comprising a second roller blind driven by the drive shaft and disposed consecutively along a common rotational axis with the first roller blind, wherein rotation of the rotatable control element rotates the first roller blind relative to the drive shaft and the second roller blind.

8. The roller blind device of claim 7, wherein the rotatable control element is located between the first roller blind and the second roller blind for direct manual adjustment of the first roller blind.

9. The roller blind device of claim 2, wherein rotation of the rotatable control element rotates the roller blind relative to the drive shaft.

10. The roller blind device of claim 9, wherein the rotatable control element provides for direct manual adjustment of the roller blind.

11. The roller blind device of claim 4, wherein the roller blind is a first roller blind, the roller blind device further comprising a second roller blind driven by the drive shaft and disposed consecutively along a common rotational axis with the first roller blind, wherein rotation of the rotatable control element rotates the first roller blind relative to the drive shaft and the second roller blind.

12. The roller blind device of claim 11, wherein the rotatable control element is located between the first roller blind and the second roller blind for direct manual adjustment of the first one roller blind.

13. The roller blind device of claim 5, wherein rotation of the rotatable control element rotates the roller blind relative to the drive shaft.

14. The roller blind device of claim 13, wherein the rotatable control element provides for direct manual adjustment of the roller blind.

* * * * *